US005797788A

United States Patent [19]

Graf et al.

[11] Patent Number: 5,797,788

[45] Date of Patent: Aug. 25, 1998

[54] GRINDING A MOUNTED CARD CLOTHING

[75] Inventors: Ralph A. Graf, Freienbach; Stefan Geisser, Rapperswill, both of Switzerland

[73] Assignee: Graf & CIE AG, Rapperswill, Switzerland

[21] Appl. No.: 801,087

[22] Filed: Feb. 14, 1997

[30] Foreign Application Priority Data

Feb. 15, 1996 [DE] Germany ..... 196 05 635.7

[51] Int. Cl.[6] ..... B24B 47/22

[52] U.S. Cl. ..... 451/28; 451/416; 451/423; 451/426

[58] Field of Search ..... 451/143, 416, 451/49, 162, 164, 423, 426

[56] References Cited

U.S. PATENT DOCUMENTS

| | | | |
|---|---|---|---|
| 294,962 | 3/1884 | Brierley | 451/416 |
| 875,411 | 12/1907 | Chesbro | 451/423 |
| 3,881,281 | 5/1975 | Hollingsworth | 451/416 |
| 4,327,525 | 5/1982 | Ennis | 451/416 |
| 4,575,972 | 3/1986 | Ohki et al. | 451/416 |
| 4,581,856 | 4/1986 | Theien | 451/423 |
| 4,984,395 | 1/1991 | Demuth . | |
| 5,277,000 | 1/1994 | Demuth et al. | 451/416 |

FOREIGN PATENT DOCUMENTS

| | | |
|---|---|---|
| 0 497 736 | 1/1992 | European Pat. Off. . |
| 516 224 | 12/1930 | Germany . |
| 646 210 | 5/1937 | Germany . |

*Primary Examiner*—Robert A. Rose
*Assistant Examiner*—George Nguyen
*Attorney, Agent, or Firm*—Herbert Dubno; Andrew Wilford

[57] ABSTRACT

A card clothing is mounted on a support and rotatable therewith about an axis. A grinding apparatus for the card clothing has an abrasive grinding element, a base juxtaposed with the card clothing, and an elastic biasing element for pressing the grinding element radially of the axis against the card clothing so that when the support and card clothing are rotating the element grinds the card clothing. The grinding element is displaceable radially outward away from the card clothing against a force of the biasing element from a grinding position engaging the card clothing to a rest position out of contact with the card clothing. The apparatus has a mechanism for withdrawing the grinding element against the force of the biasing element into the rest position and for retaining it in the rest position. An abutment is provided furthermore for defining a position of closest approach of the grinding element to the axis and hence, how much it will grind down the card clothing.

14 Claims, 6 Drawing Sheets

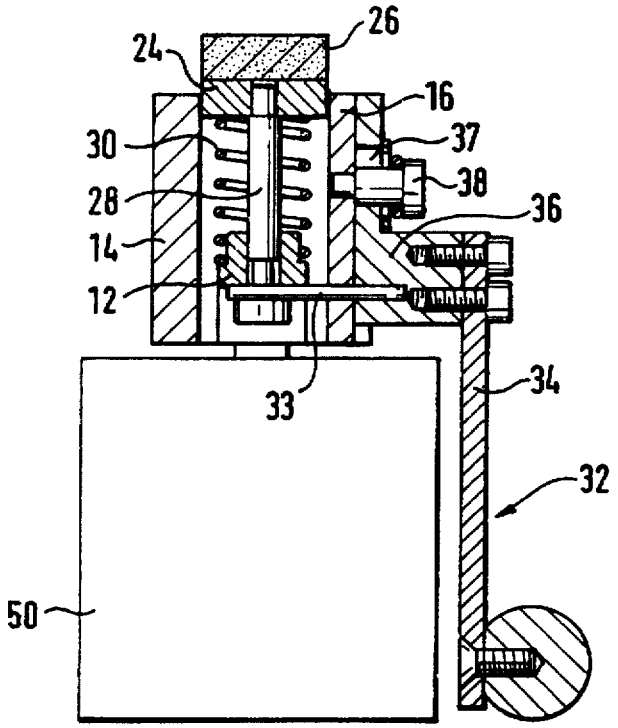
FIG. 3
FIG. 4
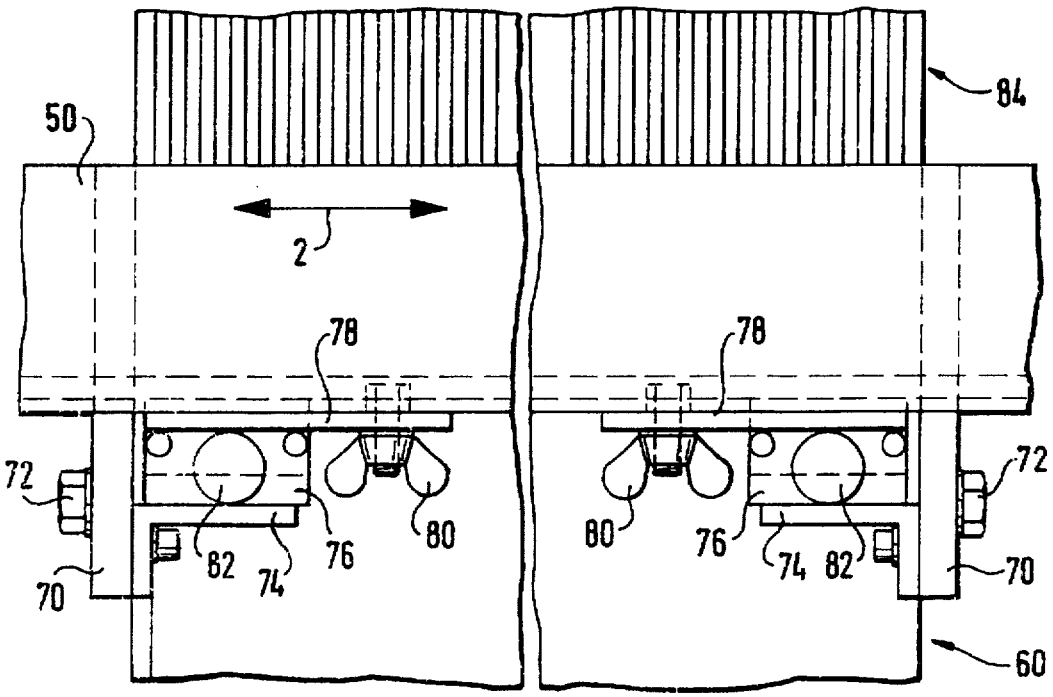

GRINDING A MOUNTED CARD CLOTHING

FIELD OF THE INVENTION

The present invention relates to the grinding of a card clothing while it is mounted on a support. More particularly this invention concerns a method of and apparatus for carrying out such a grinding operation.

BACKGROUND OF THE INVENTION

A card clothing mounted on a support is ground by means of a grinding element and a feed element that presses the grinding element against the card clothing. Such grinding devices are used for example for grinding full-steel card clothings on cards and carding machines after refitting as well as for resharpening worn card clothings. With the known grinding apparatuses a grinding element is used in the shape of a grinding ring that is mounted on a smooth hollow shaft extending perpendicular to the attack direction. In order to carry out the grinding operation, the grinding ring is rotated with the hollow shaft. Simultaneously the grinding ring is driven longitudinally of the hollow shaft, that is transverse to the attack direction, by means of a traverse spindle mounted in the hollow shaft. The grinding element is driven by a pulley with the use of a motor already used for driving the card or by a separate motor. In addition a grinding apparatus is known wherein the grinding ring is driven together with a motor serving to rotate the drive ring by means of toothed belts or a spindle drive transverse to the attack direction.

With the known grinding apparatus the positioning of the grinding element and pressing the grinding element against the card clothing are done by spindles that are mounted on the grinding apparatus or a frame of the card or carding apparatus. An increase in the amount of advance thus brings about a corresponding increase in the removal at the card-clothing tips. To ensure a satisfactory grinding operation here the necessary continuous change of the advance is set by actuating the spindle while visually monitoring the distance sparks fly. With alloyed card clothings that do not produce sparks when ground the necessary change of the amount of advance is effected by monitoring the grinding noise. Thus the grinding quality depends during use of the known grinding apparatus of the described type mainly from the knowledge and experience of the operating personnel as well as from the condition of the grinding ring. In addition the known grinding apparatus requires the presence of the operating personnel during the entire grinding operation.

Other arrangements described in German patents 516,224 and 646,210, and in European patent application 0,497,736 of Fritsche, and U.S. Pat. No. 4,984,395 of Demuth offer partial solutions. None offers a complete and satisfactory solution.

SUMMARY OF THE INVENTION

A card clothing is mounted on a support and rotatable therewith about an axis. A grinding apparatus for the card clothing has according to the invention an abrasive grinding element, a base juxtaposed with the card clothing, and an elastic biasing element for pressing the grinding element radially of the axis against the card clothing so that when the support and card clothing are rotating the element grinds the card clothing.

With such a feed element during the entire grinding process the desired grinding quality is ensured along with the necessary advance force of the grinding element without any manual, acoustic, or visual monitoring during the actual grinding operation itself. To this end all that is needed is the appropriate setting of the advance force serving for the automatic feed, for example the restoring force working against the elastic deformation of the prestressing device. This can be done without difficulty during the manufacture or installation of the grinding device so that it is possible to achieve at the site a simple and high-quality grinding without continuous monitoring of the grinding apparatus by appropriate service personnel.

More particularly according to the invention the grinding element is displaceable radially outward away from the card clothing against a force of the biasing element from a grinding position engaging the card clothing to a rest position out of contact with the card clothing. With such positioning the grinding element can be engaged without problems against the card clothing to be ground. The apparatus further has according to the invention a mechanism for withdrawing the grinding element against the force of the biasing element into the rest position and for retaining it in the rest position, so that a nonrotating grinding element can be used. An abutment is provided furthermore for defining a position of closest approach of the grinding element to the axis and hence, how much it will grind down the card clothing.

The withdrawing mechanism is engaged between the base and the grinding element and can be manually actuated for withdrawing the grinding element into and retaining it in the rest position. It allows the grinding element to be pulled back and locked in the outer position in which it is out of contact with the card clothing. The mechanism includes at least one lever pivoted on the base and carrying a cam operatively engaging the grinding element. The biasing element is a spring compressed between the grinding element and the base.

With some card clothings, for example with a card clothing drawn over the drum of a card, the region to be ground can be more than 1 meter long. Such card clothings can be ground without the use of an excessively large grinding element when the grinding apparatus has in accordance with the invention a guide extending parallel to the axis adjacent the support. The base is slidable along the guide. A drive is provided for displacing the base along the guide. This drive reciprocates the base along the guide with reversal of travel direction at ends of the support. Guides carried on the base and extending radially of the axis slidably support the grinding element. In order to compensate along the travel path for irregularities or to simplify the setting of a stationary grinding element a ball joint on the base carries the grinding element so that the grinding element is tippable on the ball joint. To ensure that the advance force of the grinding elements is uniform it is particularly advantageous when the prestressing device is movable together with the grinding element along the travel path.

To produce a portable unit the grinding element and the prestressing device as well if desired as the abutment element and/or the actuating element are preferably mounted on a slide which is fixed on a support element and movable along a path-defining guide of the support element. Such a unit comprised of the slide and the support element can be mounted by appropriate holders without problems on different cards and carding devices.

To reduce a long travel path it is suggested to provide along the region to be ground a plurality of grinding-element parts which can each be traversed along a respective part of the region to be ground. These parts are spaced apart along the axis and the biasing element includes respective springs braced between the grinding-element parts and the base. Here, once again, a swivel joint is provided between each of the grinding-element parts and the base permitting tipping of the grinding-element parts relative to the base.

The grinding method according to the invention entails supporting an abrasive grinding element adjacent the card clothing, rotating the card clothing and support about the axis, and elastically pressing the grinding element radially of the axis against the card clothing so that the element grinds the card clothing. Normally radial inward advance of the grinding element is arrested by operative engagement of the grinding element with an abutment at a predetermined radial spacing from the axis.

More particularly according to the invention, prior to starting rotation of the support and card clothing one establishes for the grinding element a radial inner position relative to the axis, and then withdraws the grinding element radial outward to a radial outer position relative to the axis. Then after the support and card clothing have been set in rotation and are up to speed the grinding element is released to move radially inward to the radial inner position under the spring force of the biasing element.

In addition according to the invention the grinding element is displaced axially along the card clothing during grinding. In fact it is reciprocated back and forth and normally the grinding depth is a direct function of the grinding time and/or of the number of reciprocations.

BRIEF DESCRIPTION OF THE DRAWING

The above and other objects, features, and advantages will become more readily apparent from the following description, reference being made to the accompanying drawing in which:

FIG. 3 is a cross section taken along line III—III of FIG. 1;

FIG. 4 shows an arrangement for mounting the grinding apparatus of the invention on the frame of a drum of a card;

SPECIFIC DESCRIPTION

Figure 1:
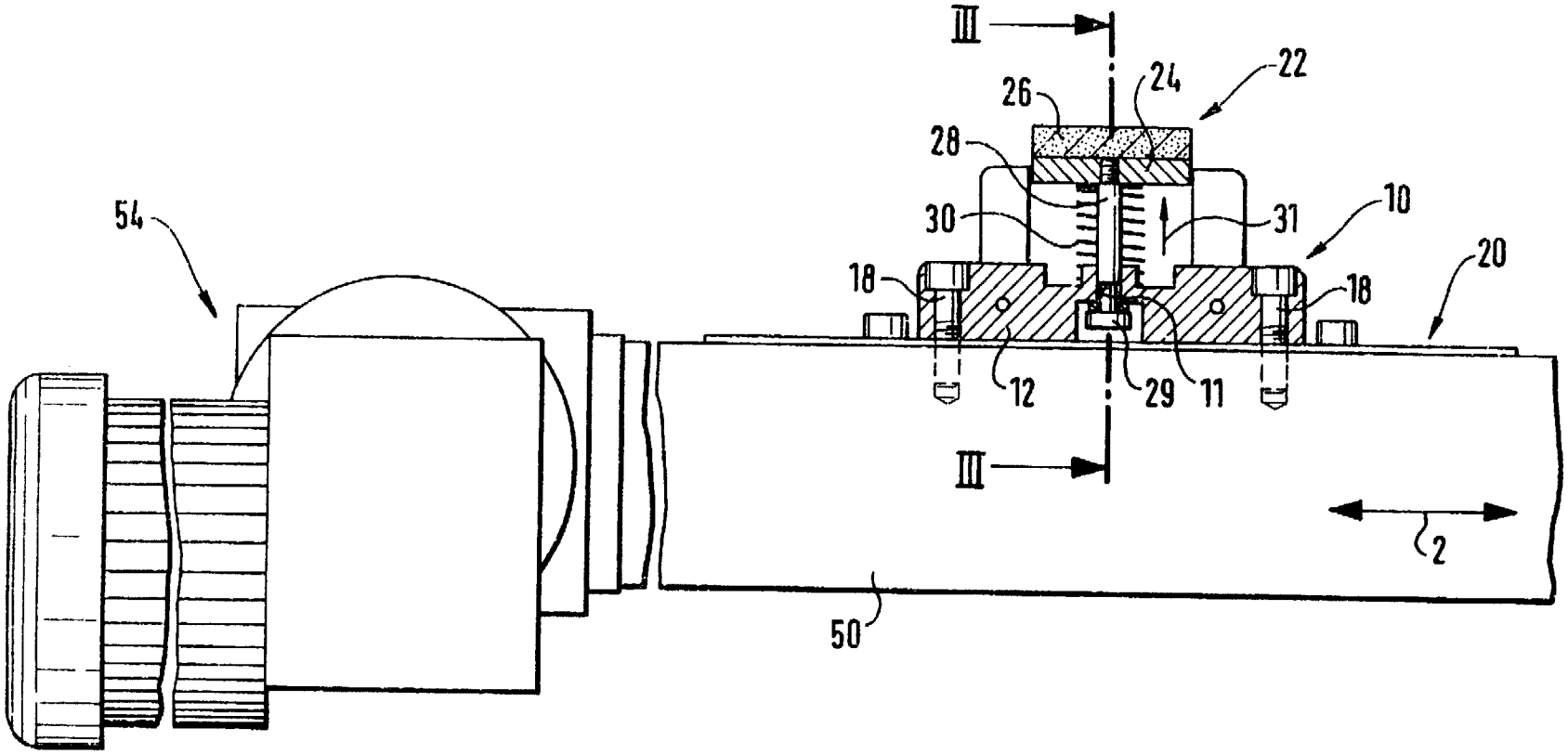
FIG. 1 is a diagrammatic side view partly in section through a grinding apparatus according to the invention.
Figure 2:
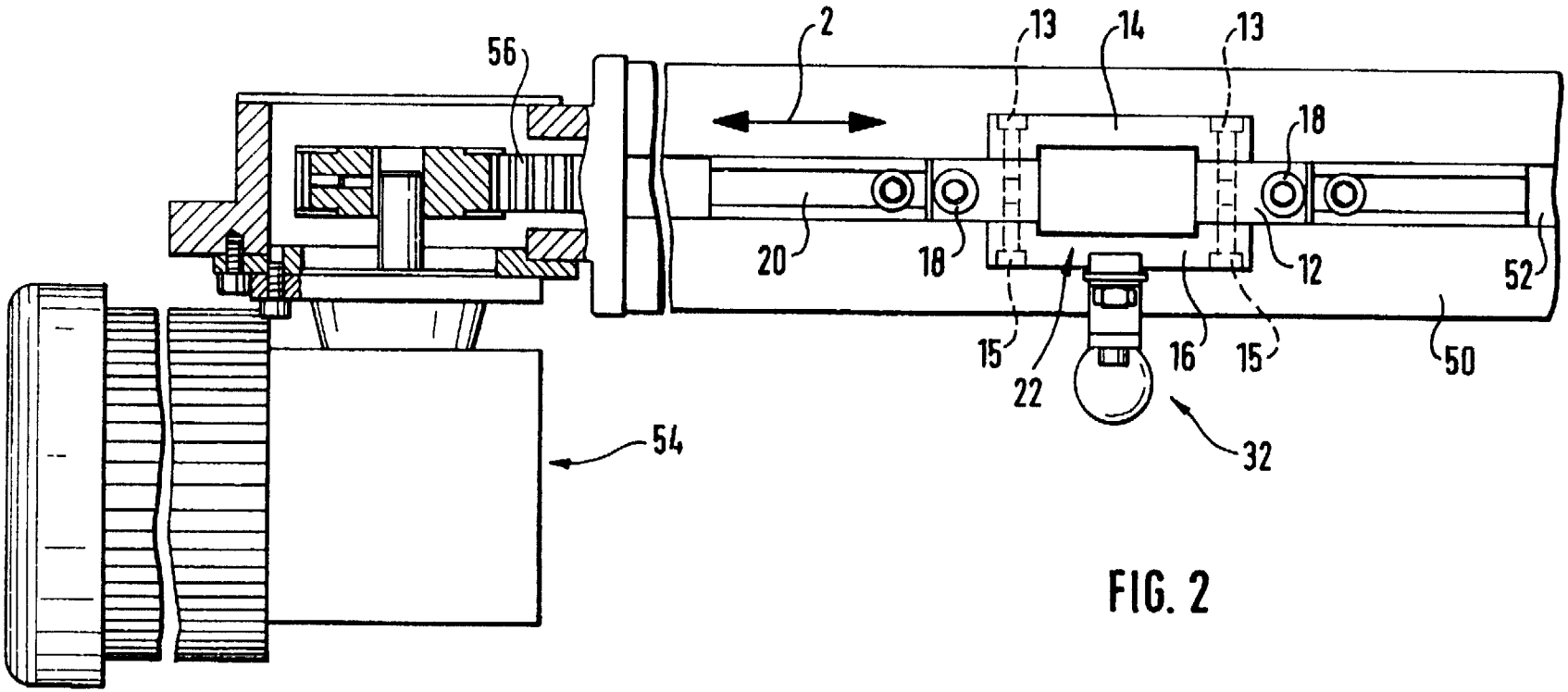
FIG. 2 is a top view partly in section through the apparatus of FIG. 1.

As seen in FIGS. 1 through 3 a grinding apparatus according to the invention has a grinding head 10 serving for grinding a card clothing. The grinding head 10 is mounted on a slide 20 that is displaceable in the direction of the double-headed arrow 2 along a guide 52 set in a support beam 50 constituted as a rigid square-section beam. The slide 20 is coupled via a toothed belt 56 to a worm-drive motor 54 responsible for this longitudinal movement. The direction of movement of the slide 20 can be reversed by means of electronic end switches (not illustrated) mounted at the ends of the guide 52. In this manner the grinding head 10 can be traversed back and forth along a card clothing.

The grinding head 10 has a base 12 secured by screws 18 to the slide 20 as well as two walls 14 and 16 extending perpendicular to the base 12 and fixed thereon by respective screws 13 and 15. Between the walls 14 and 16 there is a grinding element 22 constituted by a holder 24 and a generally square grinding stone 26 mounted thereon. As particularly visible in FIG. 2 the walls 14 and 16 extend generally longitudinally of the guide 52 of the support beam 50 and reach around end faces of the grinding element 22 which extend perpendicular of the guide 52. In this manner the walls 14 and 16 form a guide for the grinding element 22 arranged between them permitting it to move perpendicularly to the longitudinal direction 2 as indicated by arrow 31.

The grinding element 22 is mounted on the base 12 by a bolt 28 threaded into the holder 24 and traversing a bore 11 of the base 12 for sliding in the transverse direction 31. The face of the base 12 turned away from the grinding element 22 forms an abutment for a bolt head 29 of the bolt 28 and thus limits movement of the grinding element 22 in the direction 31. This defines a rest position for the grinding element 22. Between the base 12 and the holder 24 of the grinding element 22 is a prestressing device in the form of a coil spring 30 which bears at one end on the face of the base 12 turned toward the grinding element 22 and at the other end on the face of the holder 24 turned toward the base 12. This prestressing device biases the grinding element 22 in the direction 31. In this manner the grinding stone 26 can be urged during transverse movement of the grinding head 10 uniformly against a card clothing (not illustrated) and can advance during the grinding operation in the direction indicated by the arrow 31. The advancement of the grinding element and thus the material removal at the card-clothing tips is determined by the number of traverses of the grinding element across the card clothing.

As shown in FIG. 3, before a grinding operation is started the grinding element 22 can be pulled off the card clothing by an actuating element 32 comprised of a first lever 34, a second lever 36, and a link element 33 joining the second lever 36 with the threaded bolt 28 and effective against the prestressing force of the coil spring 30. The maximum range of withdrawal is established by a threaded bolt 38 seated in the wall 16 and extending through a slot 37 extending parallel to the direction 31 in the second lever 36. This threaded bolt 38 can also, if necessary along with the base 12, be used as an abutment for fixing the grinding element 22 in the rest position.

FIG. 4 shows an arrangement for fixing the grinding apparatus shown in FIGS. 1 through 3 on a frame 60 of the drum of a card. The arrangement has a holder 70 fixed by screws 72 on the frame 60. Fixed to the holder 70 are angle brackets 74 to which guide ways 76 are fixed. Support slides 78 fixed by butterfly nuts 80 on the support 50 are received in the guide ways 76. A feed mechanism 82 mounted on the guide ways 76 and the support slide 72 can move the support 50 and thus also the grinding element 22 in a direction toward a card clothing 84 on the drum.

In order to grind the card clothing 84 the holder 70 together with the support beam 50 and the grinding head 10 is mounted on the frame 60 with the drum not rotating. Then the support beam 50 with the slides 78 received in the guide ways 76 to both sides of the frame 60 is advanced by actuation of the feed mechanism 82 until the grinding stone 26 engages the card clothing 84. Then the grinding stone 26 is pulled back from the card clothing by means of the actuating element 82. Subsequently the drum is brought up to its production speed and the support beam or the grinding head according to the desired amount of grinding is moved further 0.5 to 1 mm toward the card clothing 84. Once the slide-drive motor 54 is started, that is after the start of traversal of the grinding head in the direction shown by the double-headed arrow 2, the grinding operation is actually started by operation of the actuating mechanism 32.

As a result of the prestressing of the spring 30 during the grinding operation, the grinding stone 26 is uniformly urged in the direction 31 toward the card clothing 84 until the desired grinding depth is reached. In order to get the desired material removal from the card clothing the grinding head 22 moves over the card clothing 84 up to ten times. Prestressing devices with different prestressing forces are used according to the type of card clothing, for example by changing the coil spring 30, to determine the grinding depth.

Figure 5:
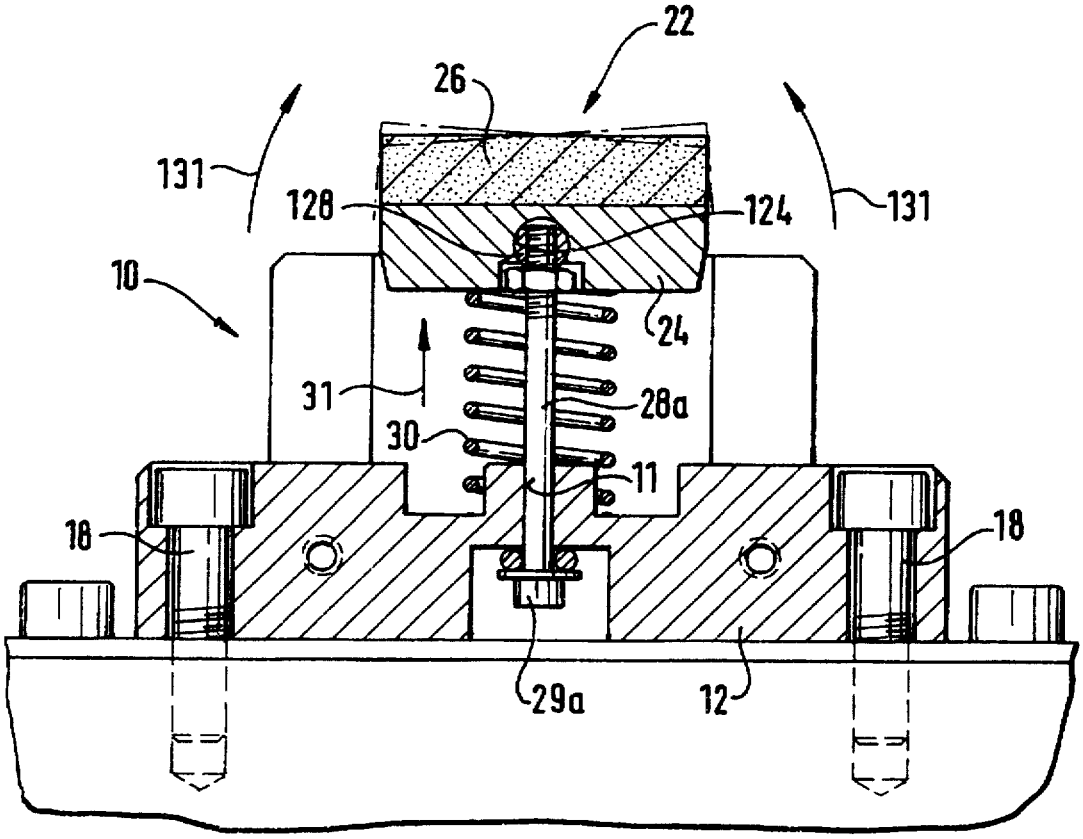
FIG. 5 is a view like FIG. 1 of another embodiment of the grinding apparatus according to the invention.

The embodiment shown in FIG. 5 is similar to that of FIGS. 1 through 4, with identical reference numerals for functionally identical structure. Here the grinding element 22, unlike in the first embodiment, is fixed by a ball-link bolt 28*a* on the base 12 of the grinding head 10. To this end the ball-link bolt 28*a* extends through the bore 11 of the base 12 while the face of the base 12 turned away from the grinding element 22 forms an abutment for the ball-link bolt head 29*a* of the ball-link bolt 28*a* and thus limits advance of the grinding element 22 in the direction shown by the arrow 31.

On the end of the ball-link bolt 28*a* opposite its head 29*a* is a ball 128 which is received in a complementarily formed recess 124 of the holder 24. The prestressing device also in this embodiment is a coil spring 30 braced on one side on the face of the base 12 turned toward the grinding element 22 and on the other side on the face of the holder 24 turned toward the base 12. As a result of the mounting by means of the ball 128 and the complementary recess 124 the grinding element 22 can make the rotary movement shown by the double-headed arrows 131. This movement can cancel out card-clothing irregularities occurring lengthwise of the traversing path of the grinding head 10.

Figure 6:
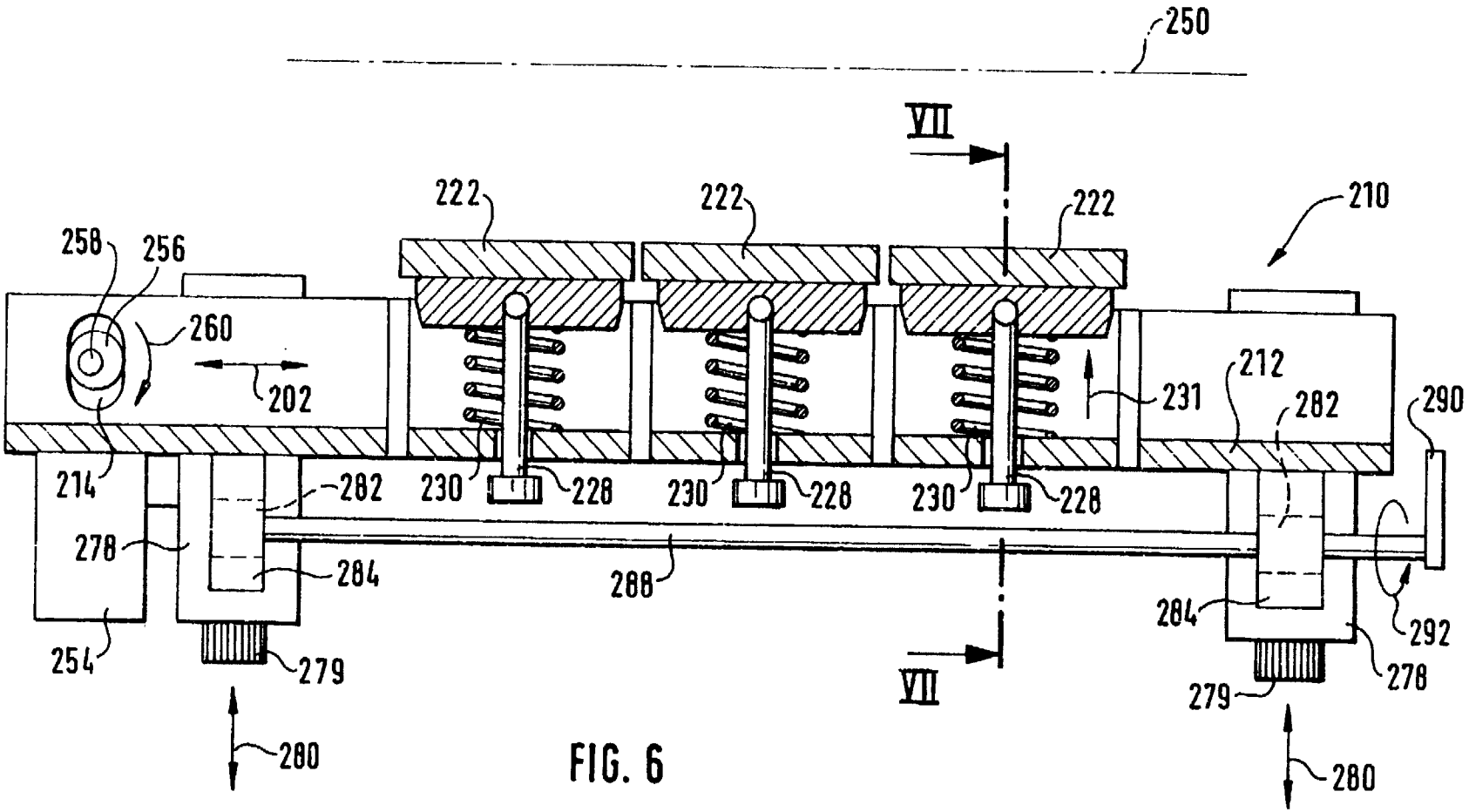
FIG. 6 is a partly sectional side view of yet another grinding apparatus in accordance with the invention.
Figure 7:
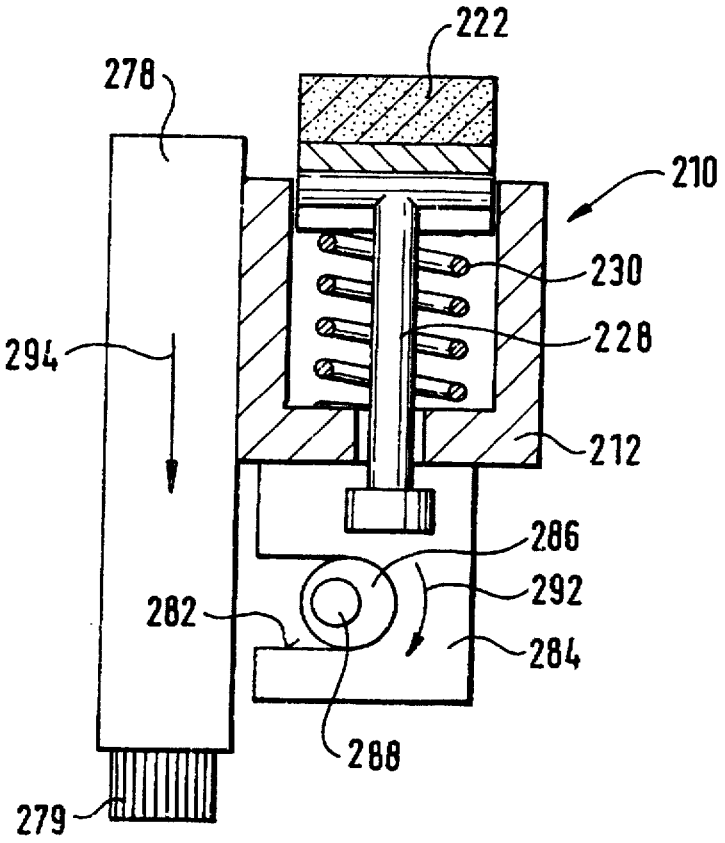
FIG. 7 is a section taken along line VII—VII of FIG. 6.

The embodiment of the invention shown in FIGS. 6 and 7 has three grinding elements 222 arranged next to one another along the rotation axis 250 of a drum of a card. Each of the grinding elements 222 is pivotally mounted on a support beam 210 by a ball-link bolt 228 traversing the floor 212 of a support beam 210. Each of the grinding elements 222 is provided with a coil spring 230 serving for prestressing the respective grinding elements 222 in a direction 231. The coil springs 230 bear on one side against the face of the floor 212 turned toward the respective grinding element 222 and on the other side on the face of the respective element 222 turned toward the floor 212.

In order to machine the card clothing drawn over the drum the grinding elements 222 together with the support beam 210 are traversed back and forth along the rotation axis 250 of the drum as shown by double-headed arrow 202. To this end there is on one end of the support beam 201 a slot 214 extending in a direction 231 generally perpendicular to the rotation axis 250 of the drum and receiving an eccentric disk 256. The eccentric disk 256 is eccentrically mounted on the output shaft 258 of a drive motor 254. In this manner rotation of the eccentric disk 256 by the drive motor 254 effects the traversing movement of the support beam 210 and also of the grinding elements 222 as shown by the double-headed arrow 202.

The support beam 210 is fixed together with the grinding elements 222 on both sides of the drum on feed slides 278 fixed on the card frame. By actuation of knurled-head screws 279 of the feed slide 278 the support beam 210 and with it also the grinding elements 222 are advanced toward and away from the card clothing of the drum as shown by the double-headed arrow 280.

The support beam 210 is shiftable relative to the feed slide 278 in the direction shown by double-headed arrow 280 so that it can be raised off the card clothing being ground independently of actuation of the knurled-head screws 279. To this end draw-off blocks 284 having cutouts 282 are provided on the floor 212 of the support beam 210 to both sides of the drum. The cut-outs 282 extend generally perpendicular to the rotation axis 250 and generally perpendicular to the longitudinal axis of the slots 214 in which are received eccentric disks 286 fixed on an eccentric shaft 288 extending parallel to the rotation axis 250. A lever 290 is fixed on one end of the eccentric shaft 288. When the eccentric disks 286 with the eccentric shaft 288 are rotated in the direction of arrow 292 out of the position of FIGS. 6 and 7 the support beam 212 and also the grinding elements 222 are lifted in the direction shown by arrow 294 from the card clothing of the drum. In this manner all the grinding elements 222 can all be raised simultaneously by simply rotating the eccentric shaft 288. This makes possible a grinding operation similar to the grinding operation described for the first embodiment of the invention wherein the grinding elements 222 at first are positioned by actuation of the knurled-head screws 279 until they touch the card clothing of the drum then on rotation of the eccentric shaft 288 by the lever 290 they are lifted from the card clothing until the drum is bought up to production speed and the support beam or the grinding head is advanced according to the desired grinding depth some 0.5 to 1 mm toward the card clothing whereupon finally the grinding drive is started by operation of the drive motor 254 and release of the lever 290.

By use of several grinding elements 222 movable along the rotation axis 250 of the drum it is possible to grind the card clothing of the drum with a transverse stroke of only about 10 mm. Then instead of the three grinding elements 222 shown in FIG. 6 some 20 grinding elements 22 are provided along the rotation axis 250 of the drum.

We claim:

1. In combination with a card clothing mounted on a support and rotatable therewith about an axis, a grinding apparatus comprising:

an abutment fixed radially of the axis:

an abrasive grinding element displaceable radially outward away from the card clothing from a grinding position engaging the card clothing and the abutment to a rest position out of contact with the card clothing;

a base juxtaposed with and fixed radially relative to the card clothing;

means including an elastic biasing element engaged between the grinding element and the base for continuously pressing the grinding element radially of the axis toward the card clothing; and means including mechanism engaged between the base and the grinding element and separate from the biasing element for withdrawing the grinding element against the force of the biasing element into the rest position and for retaining it in the rest position, whereby when the support and card clothing are rotating and the mechanism is not retaining the grinding element in the rest position the element grinds the card clothing.

2. The grinding apparatus defined in claim 1 wherein the mechanism is manually actuatable for withdrawing the grinding element into and retaining it in the rest position.

3. The grinding apparatus defined in claim 2 wherein the mechanism includes at least one lever pivoted on the base and carrying a cam operatively engaging the grinding element.

4. The grinding apparatus defined in claim 1 wherein the biasing element is a spring compressed between the grinding element and the base.

5. The grinding apparatus defined in claim 1, further comprising:

a guide extending parallel to the axis adjacent the support, the base being slidable along the guide; and drive means for displacing the base along the guide.

6. The grinding apparatus defined in claim 5 wherein the drive means includes means for reciprocating the base along the guide with reversal of travel direction at ends of the support.

7. The grinding apparatus defined in claim 1, further comprising guides carried on the base and extending radially of the axis, the grinding element being slidable in the guides.

8. The grinding apparatus defined in claim 1 further comprising a ball joint on the base carrying the grinding element, the grinding element being tippable on the ball joint.

9. The grinding apparatus defined in claim 1 wherein the grinding element has a plurality of parts spaced apart along the axis and the biasing element includes respective springs braced between the grinding-element parts and the base.

10. The grinding apparatus defined in claim 9, further comprising a swivel joint between each of the grinding-element parts and the base permitting tipping of the grinding-element parts relative to the base.

11. A method of grinding a card clothing mounted on a support and rotatable therewith about an axis, the method comprising the steps of:

a) supporting an abrasive grinding element adjacent the card clothing;

a') establishing for the grinding element a radial inner position relative to the axis;

a") withdrawing the grinding element radial outward to a radial outer position relative to the axis;

b) rotating the card clothing and support about the axis;

b') releasing the grinding element to move radially inward to the radial inner position; and c) continuously elastically pressing the grinding element radially of the axis toward the card clothing, whereby the element grinds the card clothing.

12. The grinding method defined in claim 11, further comprising the step of arresting radial inward advance of the grinding element by engagement with an abutment at a predetermined radial spacing from the axis.

13. The grinding method defined in claim 11, further comprising the step of displacing the grinding element axially along the card clothing during step c).

14. The grinding method defined in claim 11, further comprising the step of reciprocating the grinding element axially back and forth along the card clothing during step c).

* * * * *